United States Patent [19]

Leitch et al.

[11] 4,341,137

[45] Jul. 27, 1982

[54] MATERIAL FORMING APPARATUS

[75] Inventors: Paul A. Leitch, Northfield; Thomas W. Shinn, Norristown, both of Pa.

[73] Assignee: The Warner & Swasey Company, Cleveland, Ohio

[21] Appl. No.: 81,046

[22] Filed: Oct. 2, 1979

[51] Int. Cl.[3] ..... B26D 5/12; B30B 15/20

[52] U.S. Cl. ..... 83/639; 83/588; 83/552; 83/582; 83/617; 100/266; 100/269 R; 72/445; 72/453.18

[58] Field of Search ..... 83/639, 613, 588, 582, 83/552, 617; 100/266, 269 R; 173/114; 72/445, 453.18

[56] References Cited

U.S. PATENT DOCUMENTS

| | | | |
|---|---|---|---|
| 1,054,194 | 2/1913 | Gerdau . | |
| 1,311,540 | 7/1919 | Thomas . | |
| 2,405,537 | 8/1946 | Werner et al. . | |
| 3,179,998 | 4/1965 | Lamb . | |
| 3,190,215 | 6/1965 | Howard et al. . | |
| 3,427,856 | 2/1969 | Akraasari . | |
| 3,450,037 | 6/1969 | Lickliter et al. . | |
| 3,478,678 | 11/1969 | Lickliter et al. . | |
| 3,545,368 | 12/1970 | Lickliter et al. . | |
| 3,599,561 | 8/1971 | Reeves . | |
| 3,703,842 | 11/1972 | Yarlott et al. | 83/639 X |
| 3,772,954 | 11/1973 | DeRuwf | 83/588 X |
| 3,990,351 | 11/1976 | Sundin | 83/639 X |
| 4,099,436 | 7/1978 | Beneteau | 83/639 X |

*Primary Examiner*—Donald R. Schran
*Attorney, Agent, or Firm*—Yount & Tarolli

[57] ABSTRACT

A pneumatic press assembly 10 uses air pressure to power a piston 70 in a cylinder 52 through a power stroke. Springs 76, 78, 80, 82, 84, and 86 oppose the motion of the piston 70. A set of return springs (76 and 78) is effective over the entire stroke of the piston. The return springs are compactly mounted within the cylinder 52 between the bottom of the piston 70 and a shoulder 56 which extends radially inwardly from the cylinder wall. The shoulder also cooperates with a central portion 110 of the piston 70 to prevent rotation of the piston. A second set of springs (80, 82, 84, and 86) is effective only when the piston 70 is within a predetermined distance from the bottom of the power stroke. The second set of springs 80, 82, 84 and 86 is disposed between the bottom 230 of the cylinder 52 and a preload member 234. When the piston 70 approaches the bottom of its stroke, it contacts the preload member 234 which in turn compresses the springs 80, 82, 84, and 86 bringing the piston to a halt. These springs then expand, accelerating the piston 70 to a relatively high speed during an initial portion of the return stroke. During the initial portion of the return stroke, air displaced by the piston is permitted to escape freely from the cylinder. During a subsequent portion of the return stroke, the air displaced by the piston is forced through a restricted flow path to dissipate the kinetic energy of the piston. In addition, a spring loaded bumper is provided which contacts the piston at the end of the return stroke to cushion impact between the piston and the cylinder head.

22 Claims, 5 Drawing Figures

MATERIAL FORMING APPARATUS

BACKGROUND OF THE INVENTION

The present invention relates to a punch press, and in particular it relates to improvements in a fluid operated punch press.

Punch presses are used to form sheet metal. In one known type of punch press, a large flywheel is used to supply the energy needed to force a punch through a metal workpiece and into a die. The flywheel is connected with the punch through a crank mechanism which transmits the energy stored in the flywheel to the punch by converting the rotary motion of the flywheel into axial motion of the punch.

Another type of punch press, disclosed in U.S. Pat. No. 3,450,037, utilizes compressed air to power a piston in a cylinder. The piston is connected with the punch, and when air under pressure is introduced into the cylinder, the punch is driven downward through the workpiece. During its downward stroke, the piston obtains a high speed which is only partially dissipated by the impact of the punch with the workpiece. Various mechanisms have been designed to bring the piston to a halt at the bottom of its power stroke.

In a punch press mechanism which is disclosed in U.S. Pat. No. 3,545,368, a cylinder and a die are each mounted on a rigid plate. Return springs serve to return the piston to the top of its stroke. When air is introduced into the cylinder, the piston and guide rods move downward through a power stroke compressing the springs.

During operation of this type of press the piston is returned to the top of its stroke by the return springs with substantial velocity and kinetic energy. Prior art devices have utilized resilient bumpers at the top of the cylinder to absorb the energy of the fast moving piston. These resilient bumpers may deteriorate and permit the piston to impact the top of the cylinder with a substantial force. This is not only harmful to the press but may cause objectionable noise.

SUMMARY OF THE PRESENT INVENTION

The present invention provides a new and improved press assembly in which a piston is axially movable through a power stroke under the influence of fluid pressure. In the assembly the piston is accelerated through a stroke allowing it to develope kinetic energy which is used in the metal punching. Because the piston is allowed to develope kinetic energy, it can punch holes requiring more energy than would be possible by only the air pressure acting on the piston face. The assembly includes a first set of return springs which apply a force opposing motion of the piston throughout its power stroke. These return springs serve to urge the piston through a return stroke and to hold the piston at an end of return stroke position until the next power stroke.

In addition, the press assembly of the present invention includes a second set of springs which apply an upward force to the piston only when the piston is within a predetermined distance from the bottom of its stroke. During a final portion of a power stroke, the piston compresses the second set of springs, losing kinetic energy while compressing the springs. During an initial portion of the return stroke, the springs return the stored energy to the piston. This causes the piston to quickly reverse its motion and return upward at nearly the same speed it had before contact with the second set of springs.

It is necessary to bring the piston to a stationary position at the top of its stroke as quickly as possible after the punch is withdrawn from the workpiece in order to prepare the punch for the next power stroke. As previously discussed, the returning piston moves with considerable velocity. The kinetic energy embodied in the upward motion of the piston must be rapidly dissipated in order to bring the piston to rest at the top of its stroke.

To this end the air displaced by the upward motion of the piston is forced through a flow restricting valve. During an initial part of the return stroke when the punch is not yet clear of the workpiece, the air leaving the cylinder flows relatively freely through a pair of nonrestrictive valves. Once the punch is clear of the workpiece, the nonrestrictive valves close forcing the exhaust air to flow through a more restrictive valve. This results in a build-up of air pressure to decelerate the piston during a final portion of the return stroke.

As the piston approaches the end of its return stroke, most of its energy has been dissipated through the action of the restrictive valve. The piston then encounters a spring loaded bumper mechanism adapted to cushion contact between the piston and the top of the cylinder. The bumper mechanism includes an annular stop member which is disposed adjacent to the top of the cylinder. Springs extend between the stop member and the top of the cylinder. As the piston comes upward and contacts the stop member, the springs are compressed. A brief oscillation may occur as the moving piston is trapped between the return springs and the opposing bumper springs. This oscillation is damped by forcing air through the restrictive valve.

Accordingly it is an object of the present invention to provide a new and improved pneumatic press assembly having a compact arrangement to quickly reverse the motion of a piston after a power stroke to tend to minimize the length time which a punch engages a workpiece and to quietly and efficiently dissipate the kinetic energy of the piston during a final portion of its return stroke.

It is a further object of the present invention to provide a new and improved pneumatic press assembly in which two sets of springs, the first set of springs being effective over at least a major portion of the return stroke to urge the piston toward an end of stroke position and the second set of springs being effective only during the final portion of the power stroke and the initial portion of the return stroke to rapidly accelerate the piston during the initial portion of the return stroke.

It is a further object of the present invention to provide a new and improved pneumatic press assembly in which the kinetic energy of a piston returning from its power stroke is dissipated by restricting the flow of air displaced by the returning piston.

It is a further object of the present invention to provide a new and improved pneumatic press assembly having a spring loaded bumper to cushion contact between a piston and the top of a cylinder.

BRIEF DESCRIPTION OF THE DRAWINGS

These and other objects and features of the present invention will become more clear to those skilled in the art to which it pertains upon reading the following description taken together with the accompanying drawings in which.

DETAILED DESCRIPTION OF A PREFERRED EMBODIMENT OF THE INVENTION

Figure 1:
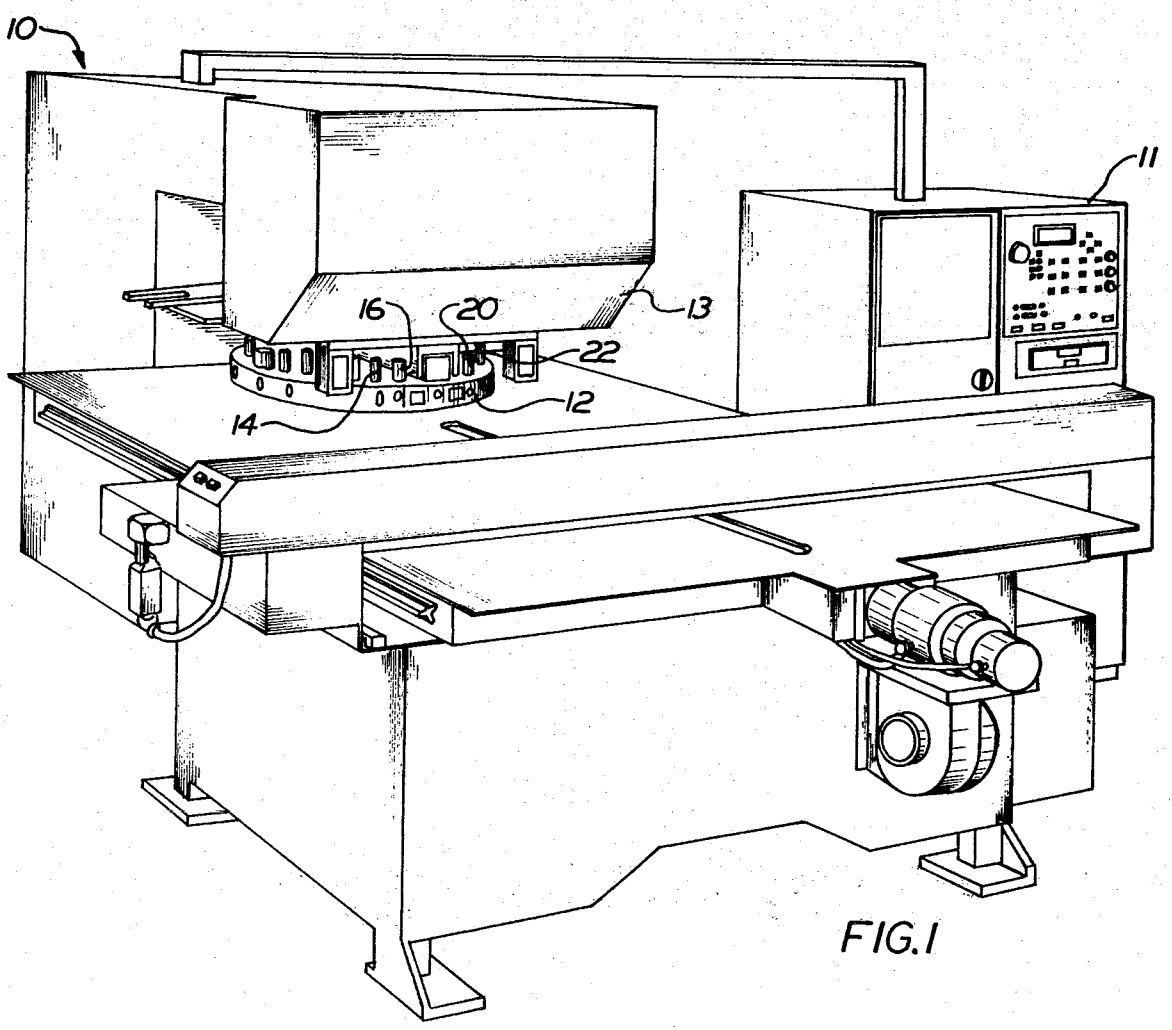
FIG. 1 is a pictorial illustration of a press assembly constructed according to the present invention.

A punch press 10 (FIG. 1) is utilized to form a sheet metal workpiece by punching holes of various shapes through the workpiece. An electronic controller 11 is utilized to automatically control motion of the workpiece beneath the punch in order that the hole through the workpiece may be placed at the desired location. The manner in which the controller 11 cooperates with the press 10 to control motion of the workpiece is well known and is generally the same as is disclosed in U.S. Pat. No. 3,436,998.

Figure 2:
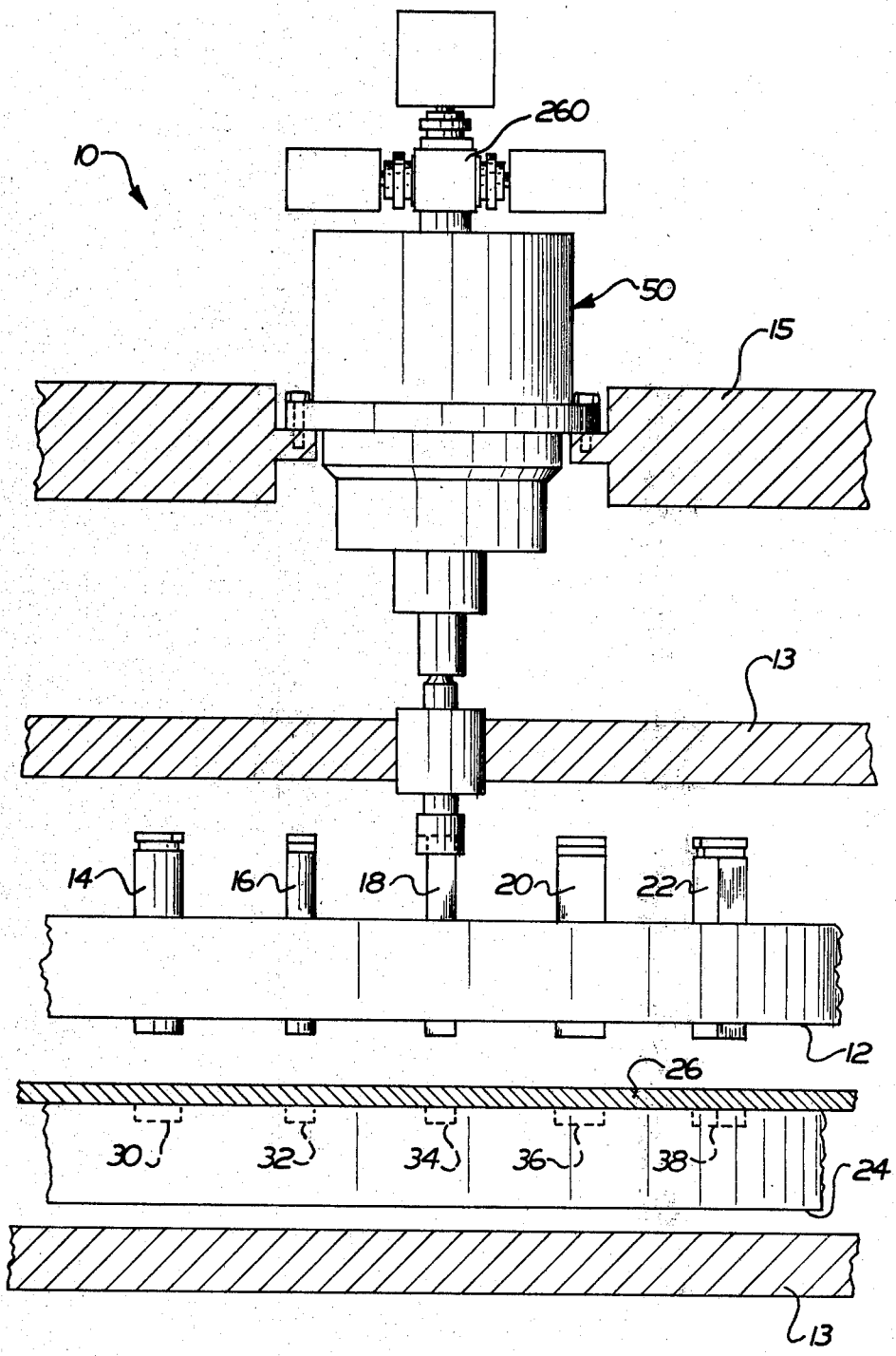
FIG. 2 is a partially broken away front sectional view of a portion of the press assembly of FIG. 1 and illustrating the relationship between a head assembly, a rotatable turret supporting a plurality of punches, and a rotatable turret supporting a plurality of dies.

The punch press 10 (FIG. 2) also includes a turret 12 which is rotatable with respect to a machine frame 13. The turret 12 includes a plurality of punches or material forming tools 14, 16, 18, 20 and 22, each for forming a hole of a different size or shape in the workpiece 26. The punch press 10 also includes a turret 24 which lies below the workpiece 26 (as viewed in FIG. 2) and which is rotatable with respect to the frame 13 in synchronism with the upper turret 12. The lower turret 24 includes a number of dies 30, 32, 34, 36 and 38 which correspond to the punches 14, 16, 18, 20, and 22. The electronic controller 11 (FIG. 1) causes the turrets 12 and 24 to rotate to selectively index a punch, i.e. 18, and the corresponding die, i.e. 34, above and below the workpiece 26.

When the desired punch 18 and die 34 have been properly indexed beneath the head assembly 50 and the workpiece 26 has been moved to the proper location on the punch press 10, the punch is driven through the workpiece by the head assembly 50 to form a hole of the desired shape at the desired location. The head assembly 50 is connected with the upper frame member 15 which is sufficiently rigid to hold the die 34 and the workpiece 26 in a fixed position while the head assembly 50 drives the punch 18 through the workpiece. Rubber pads may be used to isolate the head assembly 50 from the upper frame member 15.

Figure 3:
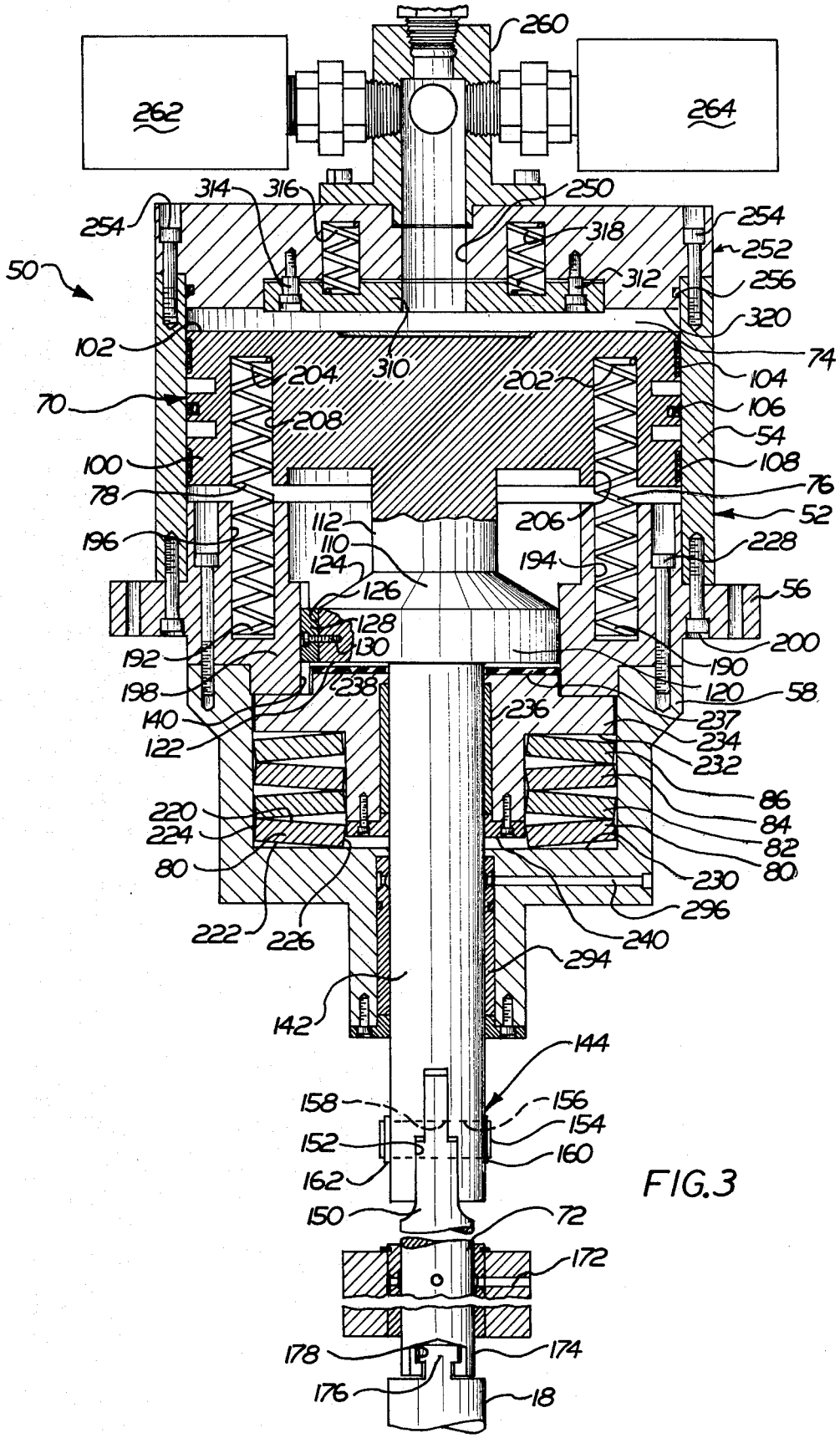
FIG. 3 is an enlarged sectional view of the head assembly of FIG. 2 illustrating a piston, a cylinder, valves for controlling a flow of air to and from the cylinder, two sets of return springs, and a bumper assembly, the piston being shown in a position between its end of power and return stroke positions.

An enlarged sectional view of the head assembly 50 is shown in FIG. 3. Generally, the head assembly 50 includes a cylinder assembly 52 composed of a main cylinder member 54, an intermediate cylinder member 56, and a lower cylinder member 58. Axially slidably within the cylinder assembly 52 is a piston 70 which is connected with the punch 18 through an intermediate shaft 72. When the piston moves downward through a power stroke, the punch 18 is forced through the workpiece 26 (FIG. 2) to form a hole of the desired shape in the workpiece.

When pressurized fluid, such as air, is admitted into chamber 74 (FIG. 3), the piston 70 is driven downward through a power stroke. The return springs 76 and 78 oppose all downward motion of the piston 70, but the force that the return springs apply is overcome by the pressure of the fluid in chamber 74. Once the punch 18 has penetrated the workpiece 26 (FIG. 2), the piston 70 (FIG. 3) is slowed by the action of the Belleville springs 80, 82, 84 and 86. After the punch has moved through the workpiece to form a hole in the workpiece, the Belleville springs 80, 82, 84 and 86 are effective to accelerate the piston 70 upwardly to quickly disengage it from the workpiece. During a final portion of its return stroke, the piston 70 is slowed by restricting the flow of air displaced from the chamber 74 by the upward motion of the piston. Although the specific preferred embodiment described herein utilizes compressed air as the driving fluid, it is contemplated that other fluids, either liquid or gaseous, may be used.

The piston 70 (FIG. 3) includes a number of integrally formed coaxial sections each having radial symmetry. Thus, the piston 70 has a cylindrical upper end or head portion 100 which has a circular end face 102. The cylindrical upper end portion 100 of the piston 70 is disposed in sliding sealing engagement with the cylindrical inside surface of the main cylinder member 54. Seals such as the seal rings 104, 106, and 108 are provided to prevent air from leaking from the chamber 74 past the piston 70. When air under pressure is introduced into chamber 74, the piston is driven downward by the force of the air pressure acting on the circular end face 102 of the piston 70.

The cylindrical head portion 100 (FIG. 3) of the piston 70 is connected with a middle section 110 of the piston by a short cylindrical connection section 112. The connecting section 112 has a diameter smaller than the cylindrical upper end portion of the piston 70. The middle section 110 of the piston has a cylindrical outside surface 120 and an annular bottom surface 122. A frusto-conical top surface 124 joins the cylindrical outside surface 120 with the connecting section 112.

The cylindrical outside surface 120 of the middle section 110 of the piston 70 is provided with an axially extending groove 126. A key 128 is held in the groove 126 by means of a suitable fastener 130 and has a tight fit with the groove. The key 128 also slidably engages a corresponding axially extending groove 140 in the intermediate cylinder member 56. The key 128 and the grooves 126 and 140 cooperate to prevent rotation of the piston 70 relative to the cylinder assembly 52 during the power and return strokes. This is important because it permits holes having non-radial symmetry to be properly oriented in the workpiece.

A cylindrical rod or shank 142 extends downward from the middle section 110 of the piston and is coaxial therewith. The rod 142 terminates with a slot and pin connection, indicated generally by the numeral 144, which connects the rod with the intermediate shaft 72. The upper end portion 150 of the intermediate shaft 72 is formed to fit in a slot 152 in the end of the rod 142. A cylindrical pin 154 extends through a cylindrical passage 156 in the rod 142 and a cylindrical passage 158 in the intermediate shaft 72. The pin 154 serves to transmit axial loads from the rod 142 to the intermediate shaft 72 and vice versa. The pin 154 is secured against axial movement by snap rings 160 and 162.

The intermediate shaft 72 extends through a bushing 170 which is mounted in the frame 13. Lubrication is supplied to the intermediate shaft 72 through a passage 172 in the bushing 170 and the frame 13.

At the lower end portion 174 of the intermediate shaft 72 there is a dovetail-like connection between the punch 18 and the shaft 72 which enables the head assembly 50 (FIG. 2) to engage any of the punches 14, 16, 18, 20, or 22 when the turret 12 is indexed. The punch 18 (FIG. 3) is equipped with a T-shaped head 176, and the intermediate shaft 72 is provided with a corresponding T-shaped groove 178. The punch 18 is thus able to slip in or out of the groove 178 in the intermediate shaft 172 as the turret 12 (FIG. 2) rotates. The head 176 (FIG. 3) on the punch 18 and the groove 178 on the intermediate shaft 72 interlock and thus enable axial forces in both directions to be transmitted from the intermediate shaft to the punch.

On the power stroke air under pressure is admitted into the chamber 74. Because the force exerted by the air on the piston 70 is proportional to the area of the end face 102, the end face is made relatively large. The sudden increase in pressure upon admission of air to the chamber 74 acts upon the circular end face 102 of the piston 70 to drive the piston downward. The rod 142 of the piston 70 drives the intermediate shaft 72 via pin 154. The intermediate shaft 72 drives the punch 18 through the workpiece 26 (FIG. 2) and into the die 34 below.

As previously noted the return springs 76 and 78 (FIG. 3) continuously oppose downward motion of the piston 70. Lower end portions 190 and 192 of the return springs 76 and 78 are received in closed ended cylindrical recesses 194 and 196 in a radially inwardly extending annular shoulder portion 198 of the intermediate cylinder member 56. The intermediate cylinder member 56 is fixedly connected with the main cylinder member 54 by means of suitable threaded fasteners 200. The upper end portions 202 and 204 of the cylindrical coil springs 76 and 78 are received in closed ended cylindrical recesses 206 and 208 in the cylindrical head portion 100 of the piston 70.

The intermediate cylinder member 56 projects radially inward from the main cylinder member 54, and the parallel recesses 194 and 196 are located radially outward from the cylindrical outside surface 120 of the middle section 110 of the piston 70. The closed ended recesses 206 and 208 in the head portion 100 of the piston 70 are parallel to each other and to the central axis of the piston and are disposed radially inward from the outside surface of the head portion 100 of the piston in axial alignment with the recesses 194 and 196 in the intermediate cylinder member 56. This arrangement of the recesses 194, 196, 206, and 208 which receive the return springs 76 and 78 provides a compact mounting arrangement for piston return springs 76 and 78.

The Belleville springs 80, 82, 84 and 86 are effective only during a final portion of a power stroke and the initial portion of a return stroke to first retard downward motion of the piston 70 and to then promote upward motion of the piston. Each of the Belleville springs is an annular member made of spring steel. Each spring has a pair of parallel annular upper and lower major side surfaces and a pair of cylindrical edges or minor side surfaces. Thus, the spring 80 has parallel major side surfaces 220 and 222 which extend between annular outer and inner minor side surfaces 224 and 226.

When there is no load on the Belleville springs 80, 82, 84, 86, the cylindrical edges 224 and 226 are axially offset from each other, but under a load the edges become less offset. When the Belleville springs are resiliently deflected under load they store potential energy which is subsequently used to accelerate the piston 70. Although the one preferred embodiment of the present invention described herein utilizes Belleville springs, this is not to be construed as a limitation upon the scope of the invention herein claimed. It is contemplated that other types of springs may also be used.

The four Belleville springs 80, 82, 84 and 86 (FIG. 3) are disposed in a stacked arrangement surrounding the rod 142 of the piston 70. The bottom of the lowest Belleville spring 80 abuts an annular surface 230 on the lower cylinder member 58 which is fixedly connected with the intermediate cylinder member 56 by suitable threaded fasteners 228. The top of the uppermost Belleville spring 86 abuts an annular bottom surface 232 of a preload member 234.

The preload member 234 circumscribes the rod 142 of the piston 70. The preload member 234 includes a cylindrical bushing 236 to facilitate sliding contact between the rod 142 and the preload member 234. The preload member 234 is urged upward by the stack of Belleville springs 80, 82, 84 and 86. Upward movement of the preload member 234 is limited by a radially inwardly projecting shoulder 198 on the intermediate cylinder member 56. The axial location of the shoulder 198 determines the preload to be applied to the stack of Belleville springs 80, 82, 84 and 86.

When the piston 70 moves downward and a punch has moved all the way through the workpiece 26 (FIG. 2), the annular bottom surface 122 (FIG. 3) on the middle section 110 of the piston 70 abuts a rubber pad 237 on an annular surface 238 on the top of the preload member 234. The force of the contact between the bottom surface 122 of the piston and the pad 237 on top of the preload member 234 causes the Belleville springs 80, 82, 84 and 86 to be compressed. The Belleville springs 80, 82, 84 and 86 limit downward motion of piston 70. The Belleville springs 80, 82, 84 and 86 are stiff enough to prevent the annular surface 240 on the bottom of the preload member 234 from engaging a surface 230 even when there is no workpiece. The resiliently compressed Belleville springs and the return springs 76 and 78 drive the piston 70 back toward the top of its stroke. When the preload member 234 again engages the shoulder 198, the piston 70 is moving upwardly with nearly the same velocity as it had when it engaged the preload member during the power stroke.

The function of the Belleville springs 80, 82, 84, and 86 is to store energy which is used to reverse the motion of the piston 70 at the end of its power stroke and to prevent piston 70 from impacting the end of cylinder 230. Because the piston 70 is moving with considerable speed when it starts to compress the Belleville springs 80, 82, 84 and 86, the Belleville springs must be relatively stiff.

The function of the return springs 76 and 78 is to withdraw the punch 18 from the workpiece 26 (FIG. 2) on the return stroke of the piston 70 (FIG. 3). This occurs after the piston 70 has been accelerated upwardly under the influence of the Belleville springs 80, 82, 84 and 86. Consequently the return springs 76 and 78 are substantially less stiff than the Belleville springs 80, 82, 84 and 86.

If the head assembly 50 is to be efficient it must operate rapidly. The returning piston has considerable velocity and since the combined weight of the piston 70, the intermediate shaft 72, and the punch 18 is considerable, the upward velocity of the returning piston represents a considerable amount of kinetic energy. The kinetic energy embodied in the returning upward moving piston must be rapidly dissipated in order to achieve the desired efficiency and press operating speed.

The upward kinetic energy of the piston 70 is dissipated by restricting the flow of air which is displaced as the piston 70 moves upward. The central passage 250 (FIG. 3) through the cylinder head 252 conducts air into and out of the chamber 74. Cylinder head 252 is fixedly connected with the main cylinder member by suitable threaded fasteners 254 and is sealed by a suitable seal ring 256. A manifold 260 provides fluid communication between the passage 250 in the cylinder head 252 and a plurality of solenoid operated valves, two of which are indicated by the numerals 262 and 264.

Figure 4:
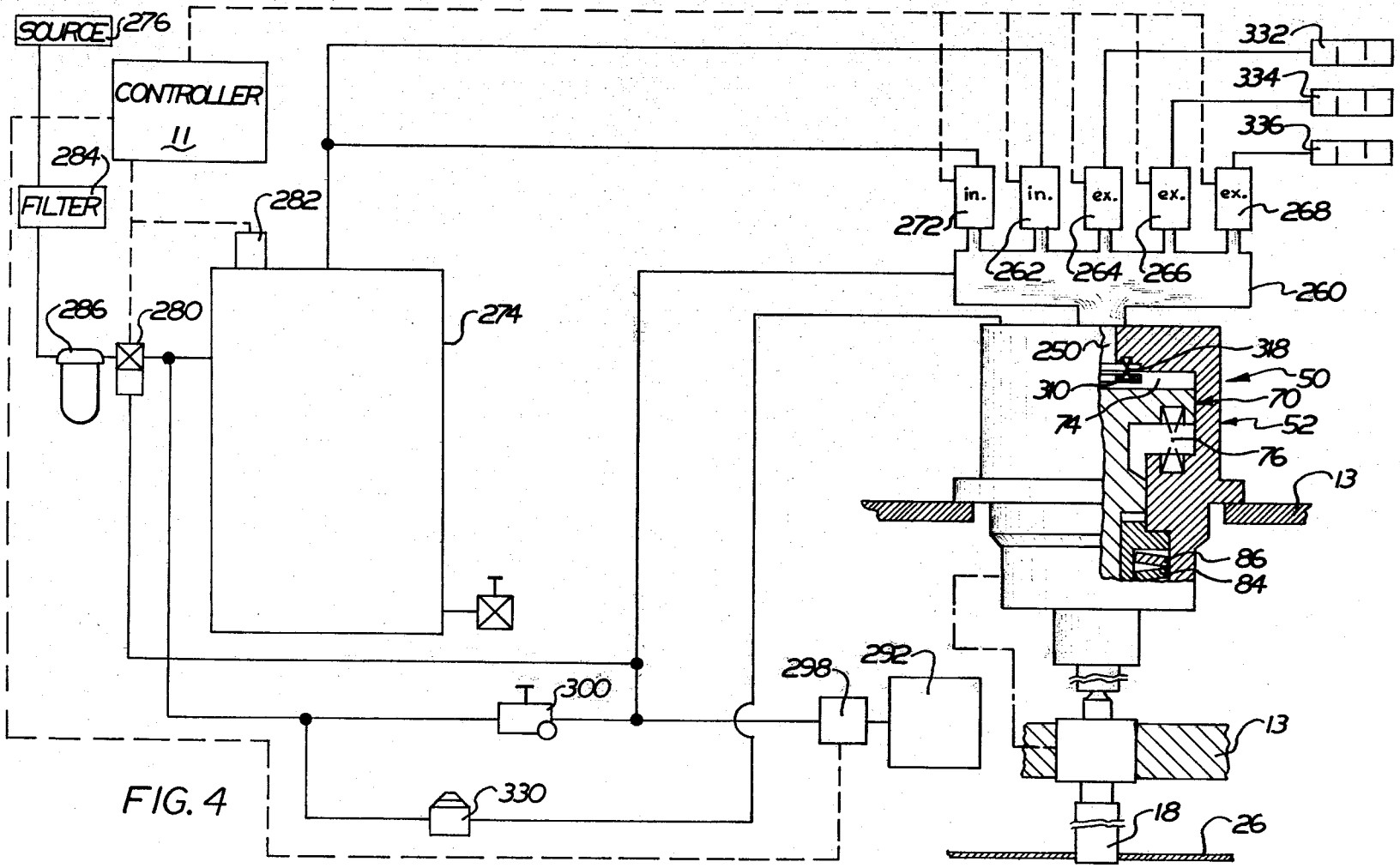
FIG. 4 is a schematic illustration of a pneumatic circuit for controlling the flow of air into and out of the head assembly of FIGS. 2 and 3.

As can be seen schematically in FIG. 4, there are three exhaust valves 264, 266 and 268 connected with the manifold 260. Two of these exhaust valves 266 and 268 are the primary exhaust valves and permit a very free flow of air from the chamber 74 when these valves are opened. The other valve 264 is the secondary exhaust valve and permits only a much more restricted flow of air from the chamber 74 when it is opened. Further, each of the exhaust valves 264, 266, and 268 is equipped with a muffler 332, 334, and 336 which reduces noise from the operation of the head assembly 50.

Figure 5:
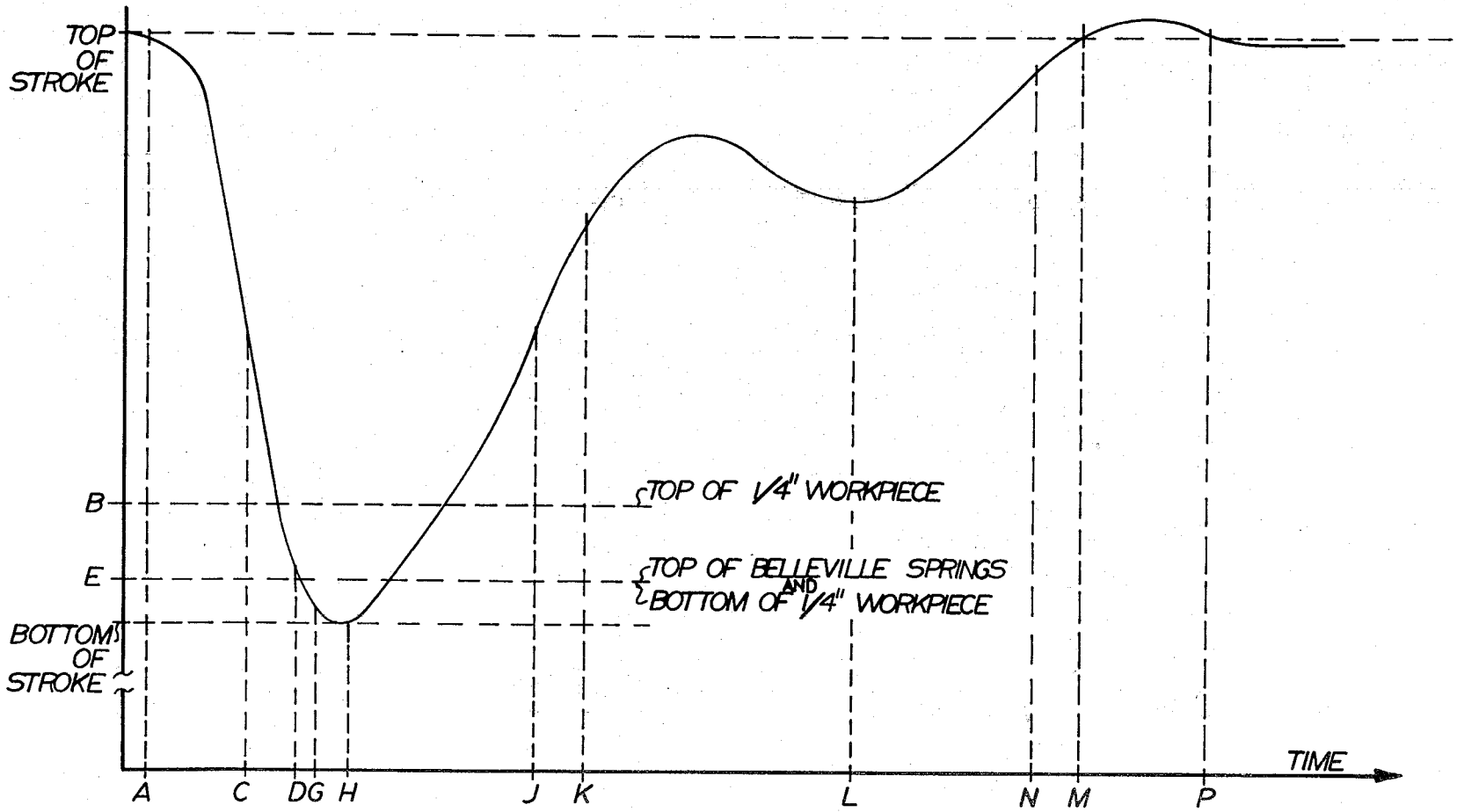
FIG. 5 is a graphical representation of the axial position of the piston measured downward from the top of its stroke as a function of time for a single complete operating cycle of the head assembly.

FIG. 4 schematically illustrates pneumatic and electric circuits which control operation of the head assembly 50. The controller 11 (FIGS. 1 and 4) regulates the opening and closing of the exhaust valves 264, 266 and 268 and of the intake valves 262 and 272 in a timed sequence. FIG. 5 is a graphical representation of the position of the piston measured downward from the top of its stroke as a function of time over a complete cycle of the head assembly, and illustrating the timing of the opening and closing of the intake and exhaust valves.

Two intake valves 262 and 272 (FIG. 4) are connected with the manifold 260 to control the influx of air under pressure into the chamber 74. The two intake valves 262 and 272 are required in order to provide a large flow of air into the chamber 74 in a very short period of time.

High pressure air is supplied by a source 276 (FIG. 4) to a pressure tank 274. The tank 274 functions as a filter to minimize variations in demand seen by the source 276. The source 276 need only supply the time averaged air demand of the head assembly 50, while the pressure tank 274 supplies the high instantaneous flow rates required.

A valve 280 and a pressure switch 282 cooperate to maintain the pressure within the tank 274 at the desired level. Of course air from the source 276 flows into the tank 274 until the pressure in the tank is the same as the pressure at which the switch 282 is set.

A filter 284 is provided between the source 276 and the pressure tank 274 to protect the head assembly 50 from particulate contaminants in the air arriving from the source 276. Lubricator 286 provides atomized oil droplets in the intake air to lubricate the air supply and the exhaust valves and the head assembly 50. In addition, an air actuated lubrication pump 292 provides lubricant to the bushing 294 (FIG. 3) in the lower cylinder member 58 through passage 296 and to the bushing 170 in the frame 13 through passage 172. The controller 11 provides an electrical pulse to operate valve 298 which controls the flow of air to operate the lubrication pump 292. The air pressure supplied to the valve 298 and the pump 292 is controlled by a regulator 300.

The controller 11 regulates the opening and closing of the solenoid actuated intake valves 262 and 272 and exhaust valves 264, 266, and 268. The controller 11 includes an ordinary electronic timer circuit which may be easily constructed by anyone skilled in the art and does not constitute a part of the present invention. The controller 11 operates the valves 262, 264, 266, 268, and 272 in a timed sequence in accordance with known valve operating characteristics.

The operating cycle starts with the piston 70 (FIG. 3) at the top of its stroke. An input to the controller 11 (FIG. 4) tells it to begin a punching operation. By the time marked A in FIG. 5 the intake valves 262 and 272 (FIG. 4) are wide open. The expanding air forces the piston 70 downward, as is indicated by the increasing distance from the top of the stroke position indicated in FIG. 5. To increase even further the amount of air available to drive the piston 70 downward when the controller 11 (FIG. 4) opens valves 262 and 272, the controller also opens valve 280 and thereby causes the source 276 to be connected directly with the manifold 260.

At any point during the stroke of the piston 70 the energy of the piston 70, the intermediate shaft 72, and the punch 18 which may be converted into useful work is equal to the sum of the kinetic energy of those components and the work available from the air pressure exerted on the end face 102 of the piston 70. By the time the punch 18 has reached the top of the workpiece 26, indicated by the dashed line B in FIG. 5, the kinetic energy of the downward moving components exceeds the energy required to punch through the workpiece.

The piston 70 is accelerated as it is driven downward by the pressure of the fluid in the chamber 74. By allowing the piston 70 to travel through a major portion of a stroke before contacting the sheet, it possesses a large amount of kinetic energy which is used in the metal punching. Because the piston 70 has kinetic energy, it can punch holes in the sheet 26 requiring more energy than would be possible with only the fluid pressure acting on the piston face 102.

The force, F, required to punch a hole in the sheet 26 is determined from the following equation:

$$F = PSt$$

where:

F = force required to punch hole
P = perimeter of hole (x diameter for round hole)
S = shear strength of material
t = thickness of sheet The energy, E, required to punch a hole in the sheet is determined by the following equation:

$$E = Fct = PSCt^2$$

F = force required to punch hole
C = percent of punch penetration before fracture occurs
t = thickness of sheet Crank type presses are limited to a certain maximum tonnage by the torque capability of the clutch. Suppose a particular crank type press has a maximum tonnage of 20 tons. In ¼ inch thick sheet of a material having a shear strength of 50,000 psi, the diameter of the maximum size hole that can be punched is 1.02 inch as determined from the above equation. In ⅛ inch thick sheet, the diameter of the maximum size hole that can be punched is 2.04 inch. The energy required to punch each of these holes is (assume C=0.50) 5,000 and 2,500 pound inch respectively. If a press of the type described here is designed to develop 5,000 pound inch of energy, then it can punch a 1.02 inch diameter hole in ¼ inch thick sheet. In ⅛ inch thick sheet it can punch a 4.07 inch diameter hole. A hole having twice the size and tonnage of that which a crank type press can punch. In thinner sheet even larger diameter holes having higher tonnages can be punched. The tonnage is limited only by the strength of the intermediate shaft 72 and the pin 154. Thus, in thin sheet a press of the type described here can punch larger and higher tonnage holes than a crank type press.

Because the kinetic energy of the piston 70 is used to punch a hole in the workpiece 26, the upper frame member 15 (FIG. 2) is not subjected to the high punching tonnages that can occur in this sheet. The upper frame member 15 is subjected only to the forces developed in the Belleville springs 80, 82, 84 and 86; the return springs 76 and 78; and the fluid pressure in the chamber 74. These forces are less than the punch loads that can occur in this sheet.

Because of the time lag between the moment the intake valves 262 and 272 start to close and the movement they are fully closed, the controller 11 starts to close the intake valves at point C (FIG. 5) which is before the punch 18 (FIG. 4) has come into contact with the top of the workpiece 26. The intake valves 262 and 272 are fully closed by point D (FIG. 5) which is approximately halfway through a one quarter inch thick workpiece 26 (FIG. 4). Even though the intake valves 262 and 272 are closed at point D (FIG. 5), the piston 70 (FIG. 4) continues downward, and at a location indicated by the dashed line E (FIG. 5) the punch 18 penetrates through the workpiece 26 and the piston 70 (FIG. 4) starts compressing the Belleville springs 80, 82, 84 and 86. The punch 18 continues downward for a short distance further, at which time the Belleville springs 80, 82, 84 and 86 (FIG. 4) reverse the motion of the piston 70 and send it back up toward the top of its stroke. Belleville springs 80, 82, 84 and 86 stop piston motion before surface 240 contacts surface 230.

At point G (FIG. 5), shortly before the bottom of the power stroke, the exhaust valves 264, 266 and 268 (FIG. 4) start to open. By the time the piston 70 is on its return stroke the exhaust valves 264, 266 and 268 are fully open. The fully opened condition of these exhaust valves is indicated at point H in FIG. 5.

During the initial portion of the return stroke, that is, before the piston 70 (FIG. 4) reaches the position corresponding to the time indicated by the letter J (FIG. 5), air exhausted from the chamber 74 (FIG. 4) is permitted to flow through both the non-restrictive primary exhaust valves 266 and 268 and through the restrictive secondary exhaust valve 264. But a time J (FIG. 5) the controller 11 (FIG. 4) starts to close the primary exhaust valves 266 and 268. By the time K the primary exhaust valves 266 and 268 are closed, and air displaced by the upwardly moving piston 70 is forced to flow through the more restrictive exhaust valve 264.

The increase in the resistance to exhaust flow causes a back pressure in the chamber 74 (FIG. 4) which slows the piston 70 on its return stroke. By time L (FIG. 5) the back pressure has stopped the piston 70 and reversed its motion. The return springs 76 and 78 (FIG. 3) apply a continuing upward force as previously discussed and urge the piston 70 upward forcing air out slowly through the secondary exhaust valve 264 (FIG. 4), and by the time M (FIG. 5) the piston 70 (FIG. 4) has reached the bumper 310.

The bumper 310 (FIG. 3) is an annular disk supported by threaded fasteners 312 and 314 for sliding motion parallel to the axis of the cylinder assembly 52. The bumper 310 is urged downward by springs 316 and 318 acting between the cylinder head 252 and the bumper 310. When the piston 70 hits the bumper 310 there may be a brief oscillation as the piston 70 is trapped between the return springs 76 and 78 and the bumper springs 316 and 318.

A regulator 330 (FIG. 4) may be used to provide a minimum pressure in the chamber 74. The minimum pressure could adjust the final uppermost position of the piston 70. Increasing the pressure setting of the regulator 330 lowers the steady state position of the piston 70.

The controller 11 starts to close secondary exhaust valve 264 at point N and the secondary exhaust valve is completely closed by the point P. This completes a cycle with the piston 70 again at the top of its stroke in preparation for another downward power stroke.

Thus it is clear that the present invention provides a new and improved pneumatic punch press 10 (FIG. 1) in which a piston 70 (FIG. 3) is axially movable through a power stroke from the top of a cylinder 52 to the bottom of the cylinder in response to the introduction of pressurized air into the cylinder. Two sets of springs urge the piston 70 upward on a return stroke toward its initial position. Thus, the piston 70 is continuously urged upwardly by the springs 76 and 78. During the initial portion of the return stroke the piston is urged upwardly by the Belleville springs 80, 82, 84 and 86. However, the Belleville springs are effective during the return stroke only while the piston is traveling from the bottom of the stroke position to the dashed line indicated by the letter E in FIG. 5.

The press 10 includes helical coil springs 76 and 78 which apply a force opposing any motion of the piston 70 downward from the top of its stroke. These springs 76 and 78 serve to urge the piston 70 upward and to hold the piston at the top of its stroke. The punch press 10 is adapted to carry the springs 76 and 78 inside the cylinder assembly 52 in a manner that affords an extremely compact arrangement.

In addition, the press 10 of the present invention includes a second set of springs 80, 82, 84, and 86 which is effective to apply an upward force to the piston only when the piston 70 is within a predetermined distance from the bottom of its stroke. When the piston 70, moving rapidly downward during its power stroke, compresses the second set of springs 80, 82, 84, and 86, it gives up its kinetic energy. The springs 80, 82, 84 and 86 subsequently return the stored energy to the piston 70, causing the piston to reverse its motion and return upward at nearly the same speed it had before contact with the second set of springs.

It is necessary to return the piston 70 to a stationary position at the top of its stroke as quickly as possible after the punch 18 is withdrawn from the workpiece 26 (FIG. 2) in order to prepare the punch 18 for the next power stroke. As previously discussed the returning piston 70 moves with considerable velocity. The kinetic energy embodied in the upward motion of the piston 70 must be rapidly dissipated in order to bring the piston to rest at the top of its stroke.

To this end the air displaced by the upward motion of the piston 70 is forced through a flow restricting valve 264 (FIG. 4). During the first part of the return stroke when the punch 18 is not yet clear of the workpiece 26, the air leaving the chamber 74 flows through a pair of non-restrictive valves 266 and 268. Once the punch 18 is clear of the workpiece, valves 266 and 268 close, forcing the exhaust air to flow through the much more restrictive valve 264. Viscous friction of the air passing through the restrictive valve 264 serves to dissipate the kinetic energy of the piston 70 (FIG. 3).

As the piston 70 approaches the top of its return stroke, it encounters a spring loaded bumper 310 adapted to stop the piston. An annular stop member 310 is disposed axially downward from and parallel to the top or end face 320 of the cylinder head 252. Springs 316 and 318 urge the stop member 310 away from the top 320 of the cylinder head 252. As the piston 70 comes upward and contacts the stop member 310, the springs 316 and 318 are compressed. A brief oscillation may occur as the moving piston 70 is trapped between the first set of return springs 76 and 78 and the opposing bumper springs 316 and 318.

Having described a specific preferred embodiment of the invention, the following is claimed:

1. An apparatus for use in forming material with a tool, said apparatus comprising housing means for defining a chamber, a piston adapted to be connected with the tool, said piston being axially movable within said chamber, means for introducing fluid under pressure into said chamber to cause said piston to move in said chamber through a power stroke in a first direction to thereby effect movement of the tool relative to the material, return means for moving said piston through a return stroke in a second direction to retract the tool from the workpiece, and dissipating means for dissipating kinetic energy of said piston as said piston moves through its return stroke in said second direction, said dissipating means including means for providing a relatively unrestricted flow path for conducting a flow of fluid displaced from the chamber by said piston at a first rate during a first portion of the return stroke and for providing a relatively restricted flow path for conducting a flow of fluid displaced from the chamber by said piston at a second rate which is less than the first rate during a second portion of the return stroke.

2. An apparatus as set forth in claim 1 wherein said means for providing a relatively unrestricted flow path for fluid displaced by said piston during a first portion of the return stroke and for providing a relatively restricted flow path for fluid displaced by said piston during a second portion of the return stroke includes a plurality of exhaust valves and control means for opening said plurality of exhaust valves during said first portion of the return stroke and for closing at least one of said exhaust valves while maintaining another of said exhaust valves open during said second portion of the return stroke.

3. An apparatus as set forth in claim 2 wherein each of said exhaust valves has means associated therewith for muffling noise of fluid displaced by said piston during its return stroke.

4. An apparatus as set forth in claim 1 wherein said chamber includes an end surface, said assembly further including bumper means connected with said housing means for engaging said piston as said piston approaches said end surface of said chamber toward the end of a return stroke to retard movement of said piston toward said end surface of said chamber, said bumper means including a rigid bumper member which is movable between an extended position projecting outwardly of said end surface into said chamber and a retracted position, and spring means disposed between said bumper member and said housing means for urging said bumper member toward said extended position, said piston having surface means for engaging said bumper member when it is in its extended position and for applying a force to said bumper member to move said bumper member toward its retracted position against the influence of said spring means as said piston approaches the end of its return stroke to thereby retard movement of said piston.

5. A pneumatic press assembly as set forth in claim 1 wherein said return means includes first spring means disposed within said housing means for engaging said piston and urging said piston in said second direction throughout at least a major portion of the return stroke, and second spring means disposed within said housing means for urging said piston in said second direction during only an initial portion of the return stroke, said initial portion of the return stroke being substantially smaller than said major portion of the return stroke.

6. A pneumatic press assembly as set forth in claim 5 wherein said first spring means has a first spring rate and said second spring means has a second spring rate, said second spring rate being greater than said first spring rate.

7. An apparatus as set forth in claim 1 wherein said piston includes a generally cylindrical head portion having a first diameter, said chamber having a cylindrical side surface disposed in engagement with said head portion of said piston, said piston having an intermediate portion with a second diameter, said second diameter being smaller than said first diameter, said housing means including a radially inwardly projecting shoulder, said shoulder having surface means defining a cylindrical surface disposed in engagement with said intermediate portion of said piston, said head portion of said piston including seal means for sealingly engaging said upper cylindrical surface of said cylinder, and means disposed between said intermediate portion of said piston and said shoulder for preventing rotation of said piston about the longitudinal axis of said cylinder.

8. An apparatus for use in forming material with a tool, said apparatus comprising a chamber, a piston adapted to be connected with the tool, said piston being axially movable within said chamber, said piston having a generally cylindrical head portion with surface means defining a circular end face which is exposed to fluid pressure during a power stroke, a generally cylindrical rod portion adapted to be connected with the tool, said rod portion of said piston having a smaller diameter than said head portion of said piston, and a cylindrical intermediate portion coaxial with and disposed between said head and rod portions, said intermediate portion having a diameter which is larger than the diameter of said rod portion and smaller than the diameter of said head portion, said chamber having a radially inwardly projecting section disposed proximate said intermediate portion of said piston, means extending between said intermediate portion of said piston and said section of said chamber for holding said piston against rotary motion relative to said chamber, means for introducing fluid under pressure into said chamber to cause said piston to move in said chamber through a power stroke in a first direction to thereby effect movement of the tool relative to the material, return means for moving said piston through a return stroke in a second direction to retract the tool from the workpiece, said return means including first spring means for urging said piston in the second direction, said head portion of said piston including surface means defining a plurality of axially extending recesses, said radially inwardly projecting section of said chamber including surface means defining a plurality of recesses aligned with said recesses in said head portion of said piston, said first spring means including a plurality of helical coil springs, one end portion of each of said springs being received in one of said recesses in said head portion of said piston and the opposite end portion of each of said springs being received in one of said recesses in said section of said chamber, said recesses in said head portion of said piston being disposed radially outwardly of said intermediate portion of said piston, and dissipating means for dissipating kinetic energy of said piston as said piston moves through its return stroke in said second direction, said dissipating means including means for providing a relatively unrestricted flow path for fluid displaced by said piston during a first portion of the return stroke and for providing a relatively restricted flow path for fluid displaced by said piston during a second portion of the return stroke.

9. An apparatus as set forth in claim 8 wherein said apparatus includes a cylinder defining said chamber, said chamber including a circular end surface disposed opposite to the circular end face of said piston, said return means further including second spring means effective to urge said piston in the second direction during an initial portion of a return stroke, said second spring means including a plurality of annular spring members disposed in stacked arrangement and each having a pair of annular major side surfaces interconnected by a pair of minor side surfaces, said minor side surfaces being offset from one another to a first extent when said spring members are in a free state and to a second extent when said spring members are under a load, said cylinder including a generally annular cylinder end member disposed opposite said end surface of said chamber and having a central passage through which said rod portion of said piston extends, a first end of said stack of spring members being disposed in abutting engagement with one side surface of said cylinder end member, said assembly further including a preload member circumscribing said rod portion of said piston, said preload member having an upper annular end surface disposed in abutting engagement with said radially projecting section of in said chamber, a second end of the stack of said annular spring members being disposed in abutting engagement with a lower annular side surface of said preload member to thereby urge said preload member in said second direction, said preload member further including a stop surface concentric and parallel to said upper annular end surface of said preload member and spaced axially from said upper annular end surface, said stop surface circumscribing said rod portion of said piston, said central portion of said piston having a lower annular contact surface axially spaced from said stop surface on said preload member when said piston is at the top of its stroke and said contact surface abutting said stop surface when said piston moves within a predetermined distance of the bottom of its stroke.

10. An apparatus for use in forming material with a tool, said apparatus comprising a cylindrical chamber having at least one end surface, a piston adapted to be connected with the tool, said piston being axially movable in said chamber, said piston having a head portion with an end face which is exposed to fluid pressure during the power stroke, a rod portion adapted to be connected with the tool, and an intermediate portion disposed between said rod and head portions, said intermediate portion having a cross sectional area which is greater than the cross sectional area of said rod portion and less than the cross sectional area of said head portion, means for introducing fluid under pressure into said cylinder to cause said piston to move in said chamber in a first direction through a power stroke and return means for moving said piston in said chamber in a second direction through a return stroke, said return means including first spring means effective during the entire return stroke of said piston to urge said piston in the second direction and second spring means effective to urge said piston in said second direction only during the final portion of the power stroke and the initial portion of the return stroke, said first spring means being effective to continuously apply a force in the second direction to said head portion of said piston, said second spring means being effective to apply a force in the second direction to said intermediate portion of said piston during the final portion of the power stroke and during the initial portion of the return stroke.

11. An apparatus as set forth in claim 10 wherein said first spring means has a first spring rate and said second spring means has a second spring rate, said second spring rate being larger than said first spring rate.

12. An apparatus as set forth in claim 10 wherein said first spring means includes a plurality of coil springs and said second spring means includes a plurality of annular spring members each of which has a central portion which is axially offset from a circular rim portion.

13. An apparatus as set forth in claim 10 further including dissipating means for dissipating kinetic energy of said piston as said piston moves through its return stroke in said second direction, said dissipating means including means for providing a relatively unrestricted flow path for fluid displaced by said piston during the initial portion of said return stroke when said second spring means is effective to urge said piston in said second direction and for providing a relatively restricted flow path for fluid displaced by said piston during a final portion of said return stroke.

14. An apparatus for use in forming material with a tool, said apparatus comprising having means for defining a cylindrical chamber having at least one end surface, a piston adapted to be connected with the tool, said piston being axially movable in said chamber, said piston including a cylindrical head portion with a circular end face which is exposed to fluid pressure during the power stroke, a rod portion adapted to be connected with the tool, and an intermediate portion disposed between said rod and head portions in a coaxial relationship with said rod and head portions, said intermediate portion having a cross sectional area which is greater than the cross sectional area of said rod portion and less than the cross sectional area of said head portion, means for introducing fluid under pressure into said chamber to cause said piston to move in said chamber in a first direction through a power stroke and return means for moving said piston in said chamber in a second direction through a return stroke, said return means including first spring means disposed within said housing means for applying force in the second direction to said head portion of said piston at a location radially outwardly of said intermediate portion of said piston, and second spring means disposed within said housing means for applying force in the second direction to said intermediate portion of said piston.

15. An apparatus as set forth in claim 14 wherein said first spring means has a first spring rate and said second spring means has a second spring rate, said second spring rate being larger than said first spring rate.

16. An apparatus as set forth in claim 15 further including bumper means disposed within said housing means for retarding movement of said piston as said piston approaches the end of a return stroke.

17. An apparatus as set forth in claim 14 wherein said first spring means includes a plurality of coil springs and said second spring means includes a plurality of annular spring members each of which is disposed in a coaxial relationship with said intermediate portion of said piston and has a central portion which is axially offset from a circular rim portion.

18. An apparatus as set forth in claim 14 further including dissipating means for dissipating kinetic energy of said piston as said piston moves through its return stroke in said second direction, said dissipating means including means for providing a relatively unrestricted flow path for conducting a flow of fluid displaced from said chamber by said piston during the initial portion of said return stroke, and for providing a relatively restricted flow path for conducting a flow of fluid displaced from said chamber by said piston at a second rate which is less than the first rate during a final portion of said return stroke.

19. An apparatus as set forth in claim 14 further including bumper means for engaging said piston during the final portion of said return stroke, said bumper means including a rigid circular bumper member disposed in a coaxial relationship with said piston and third spring means for retarding movement of said bumper member under the influence of force applied against said bumper member by said piston.

20. An apparatus as set forth in claim 14 further including retainer means extending between said housing means and said intermediate portion of said piston for holding said piston against rotation relative to said housing means.

21. An apparatus for use in forming material with a tool, said apparatus comprising housing means for defining a chamber, a piston adapted to be connected with the tool, said piston being axially movable in said chamber through a power stroke in a first direction and being axially movable in said chamber through a return stroke in a second direction, a source of fluid under pressure, tank means for holding fluid under pressure, means for conducting a flow of fluid from said source of fluid to said tank means to accumulate fluid under pressure in said tank means, means for conducting a flow of fluid from said tank means to said chamber along a first fluid flow path and for conducting a flow of fluid from said source of fluid to said chamber along a second fluid flow path which is separate from said tank means upon initiation of a power stroke to supply said chamber with fluid conducted from said tank means and with fluid conducted from said source of fluid independently of said tank means upon initiation of a power stroke.

22. An apparatus as set forth in claim 21 further including dissipating means for dissipating kinetic energy of said piston as said piston moves through its return stroke in said second direction, said dissipating means including means for defining a plurality of ports through which fluid from said chamber flows during a first portion of a return stroke and means for blocking fluid flow through at least one of said ports during a second portion of a return stroke to restrict the flow of fluid from said chamber during the second portion of the return stroke.

* * * * *